United States Patent [19]

Nagashima

[11] Patent Number: 4,615,398

[45] Date of Patent: Oct. 7, 1986

[54] THROTTLE CUSHION

[75] Inventor: Akira Nagashima, Kawasaki, Japan

[73] Assignee: Kioritz Corporation, Tokyo, Japan

[21] Appl. No.: 646,929

[22] Filed: Sep. 4, 1984

[30] Foreign Application Priority Data

Sep. 9, 1983 [JP] Japan ..... 58-139808[U]

[51] Int. Cl.[4] ..... E21B 3/00

[52] U.S. Cl. ..... 173/162 H; 30/381; 267/140; 267/153

[58] Field of Search ..... 173/162 H, 170; 30/381, 30/382, 383; 267/140, 153

[56] References Cited

U.S. PATENT DOCUMENTS 3,844,360 10/1974 Green et al. ..... 173/170

*Primary Examiner*—E. R. Kazenske
*Assistant Examiner*—Willmon Fridie, Jr.
*Attorney, Agent, or Firm*—Browdy & Neimark

[57] ABSTRACT

A throttle cushion of a portable power-driven machine has a sleeve-like elastic cushioning member fitted on the portion of a trigger engageable with a throttle valve actuating rod.

1 Claim, 2 Drawing Figures

1
2
3
4
5
6
7
8
9
10
11
12
13
11
11'
12

THROTTLE CUSHION

BACKGROUND OF THE INVENTION

The present invention relates to a throttle cushion for use in portable power-driven machine such as chain saws, grass trimmers and so forth.

Such a portable power-driven machine is known as having an internal combustion engine, a throttle actuating rod for actuating the throttle valve and a trigger pivotally mounted on a handle bar and engageable with the throttle actuating rod to operate the latter. In this type of machine, the trigger lever and the associated end of the throttle actuating rod are not mechanically connected to each other, from the view point of prevention of vibration at the engaging portions of these members, particularly during idling of the engine.

When, however, the trigger is pulled by a finger to accelerate the engine, the trigger is brought into contact with the throttle actuating rod so that the vibration of the internal combustion engine is directly transmitted to the operator's finger thus imparting an unpleasant feeling.

SUMMARY OF THE INVENTION

Accordingly, an object of the invention is to provide a throttle cushion having simple construction easy to assemble and capable of producing a large vibration damping effect, thereby overcoming the above-described problem of the prior art.

To these ends, according to the invention, there is provided, in a portable power-driven machine having a main body, an internal combustion engine mounted in the main body, a throttle actuating rod adapted to operate such as to open and close a throttle valve in the engine, and a trigger mounted on a handle bar and adapted to engage and drive the throttle valve actuating rod, a throttle cushion comprising a sleeve-like elastic cushioning member fitted on the portion of the trigger engageable with the throttle valve actuating rod.

According to this arrangement, the cushioning member can have a size large enough to ensure a large vibration damping effect to improve the maneuverability of the machine.

Another object of the invention is to provide a throttle cushion wherein the sleeve-like elastic cushion has an elongated sectional shape and is adapted to engage at its one longitudinal end with the throttle valve actuating rod, so that the vibration occurring in the direction of the load is fully absorbed by the cushioning member.

Still another object of the invention is to provide a throttle cushion wherein the cushioning member is provided with a cavity formed in the portion thereof between one longitudinal end and that part which fits the trigger so as to enhance the vibration damping effect.

These and other objects, features and advantages of the invention will become clear from the following description of the preferred embodiments taken in conjunction with the accompanying drawings.

DESCRIPTION OF THE PREFERRED EMBODIMENT

Figures 1, 2:
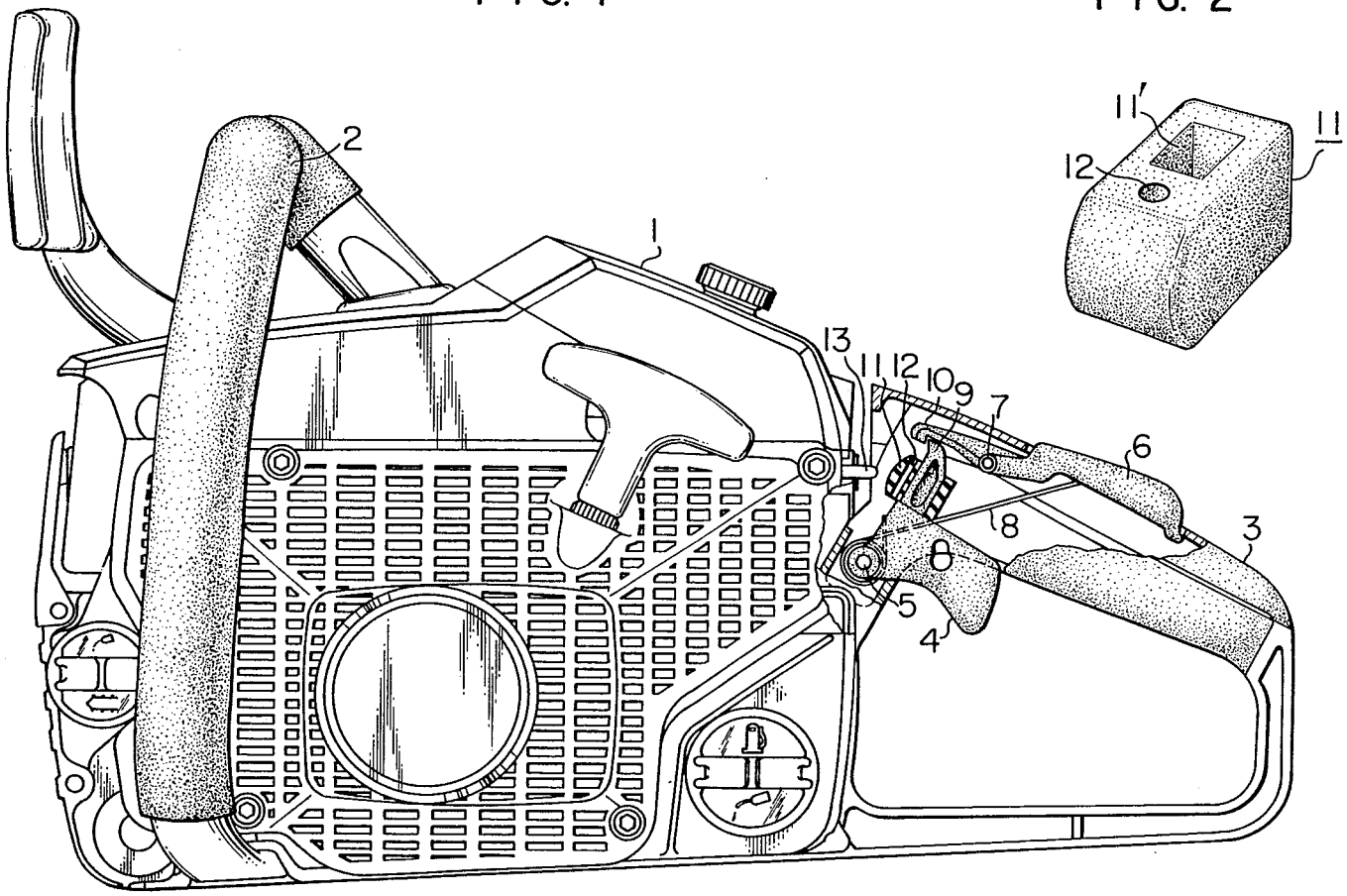
FIG. 1 is a partially-sectioned side elevational view of a chain saw equipped with a throttle cushion in accordance with the invention.
FIG. 2 is a perspective view of a cushioning member of the throttle cushion as shown in FIG. 1.

A preferred embodiment of the invention will be descrbed hereinunder with reference to the accompanying drawings.

This embodiment of the throttle cushion is applied to a chain saw having a main body 1, a front handle bar 2 attached to the main body 1, and a hollow rear handle bar 3. A small-sized internal combustion engine (not shown) is mounted in the main body 1 and is drivingly connected to an endless chain member having a multiplicity of saw teeth (not shown) such as to drive the chain member.

A trigger 4 is pivotally secured through a pivot pin 5 to a portion of the rear handle bar 3 such that the trigger 4 is naturally contacted by the flat of the fore finger of the user's hand when it grips the rear handle bar 3. A latch member 6 is pivotally secured through a pivot pin 7 to a portion of the rear handle bar 3 so as to be naturally contacted by the palm of the user3 s hand. A spring 8 is loaded between the trigger 4 and the latch member 6 so that the trigger 4 is urged in a clockwise direction around the pivot pin 5, while the latch member is urged in a counter-clockwise direction around the pivot pin 7, as viewed in FIG. 1.

The clockwise rotation of the trigger 4 and the counter-clockwise rotation of the latch member 6 are limited by the engagement between these members 4, 6 and the rear handle bar 3.

The trigger 4 has a lever portion 9 which extends into the hollow of the rear handle bar 3, while the latch member 6 has a latch portion 10 which extends through the hollow of the rear handle bar 3 towards the free end of the lever portion 9. When the latch member 6 takes the illustrated position, the latch portion 10 engages the free end of the lever portion 9 of the trigger 4 to prevent further counter-clockwise rotation of the trigger 4.

The throttle cushion of the invention has a sleeve-shaped elastic cushioning member 11 made of an elastic material such as rubber, synthetic resin or the like and having an elongated cross-sectional shape. The cushioning member 11 has a bore 11' as shown in FIG. 2 such as to fit on the lever portion 9 of the trigger 4. In FIG. 1, the cushioning member 11 is shown in longitudinal section thereof taken along the longitudinal axis thereof. The direction of the longitudinal axis of the cushioning member coincides with the direction of pivotal movement of the lever portion 9. A cylindrical cavity 12 is formed between the left end of the cushioning member 11 as viewed in the FIG. 1 and the bore 11' receiving the lever portion 9. This cylindrical cavity 12 effectively increases the vibration damping effect of the cushioning member 11.

At the left side of the cushioning member 11 as viewed in FIG. 1, a throttle valve actuating rod 13 for actuating the throttle valve of the engine projects from the main body 1 and extends into the hollow of the rear handle bar 3. The throttle valve actuating rod 13 has a suitable construction which is known per se. The arrangement is such that a leftward movement of the throttle valve actuating rod 13 causes the throttle valve (not shown) to open, thereby accelerating the engine.

For accelerating the engine of the chain saw, the user rotates the latch member 6 clockwise with his hand gripping the rear handle bar 3 such as to disengage the latch portion 10 from the lever portion 9 of the trigger 4, and then rotates the trigger 4 counter-clockwise with his fore finger. As a result, the left end portion of the cushioning member 11 is brought into engagement with the right end of the throttle valve actuating rod 13 to urge the latter leftward, so that the throttle valve is operated with a greater amount of opening, thereby accelerating the engine. When the desired power or speed of the engine is obtained, the operator holds the trigger at that position. Meanwhile, the vibration of the engine transmitted through the throttle valve actuating rod 13 is absorbed by the cushioning member 11. The vibration, therefore, is not transmitted to the trigger 4 so that the user is freed from any unpleasant feeling of vibration.

For decelerating the engine, the user simply relaxes his fore finger so that the trigger 4 springs back in the clockwise direction by the force of the spring 8. The engine slows down to idle speed when the trigger 4 has returned to the illustrated position. In this state, the throttle valve actuating rod 13 is separated mechanically from the trigger 4 so that the trigger 4 is never caused to vibrate.

As has been described, the invention provides a throttle cushion having a cushioning member with an elongated longitudinal sectional shape and adapted to engage at one longitudinal end thereof with a throttle valve actuating rod. This cushioning member, therefore, fully absorbs the vibration occurring in the direction of the load applied to the throttle valve actuating rod. The vibration damping effect is enhanced by the cavity formed in the portion of the cushioning member between one longitudinal end of the cushioning member and the hollow of the cushioning member receiving the lever portion of the trigger.

What is claimed is:

1. In a portable power-driven machine having a main body, an internal combustion engine mounted in said main body, a throttle actuating rod adapted to operate to open and close a throttle valve in said engine, and a trigger mounted on a handle bar and adapted to engage and drive said throttle valve actuating rod, a vibration damping means to dampen the vibrations between the throttle actuating rod and a means to operate the internal combustion engine through the throttle actuating rod comprising a throttle cushion formed as a sleeve-like elastic cushioning member having an opening therethrough to receive a portion of the trigger;

said throttle cushion having a cavity formed in a portion thereof between the opening receiving the portion of the trigger and a portion of said cushion engageable and disengageable with the throttle actuating rod;

the means to operate the internal combustion engine including said trigger, said portion of said trigger recieved in said opening in said throttle cushion extending from said trigger, a latch member positioned to be contacted by a hand held with a finger of the hand on said trigger, a lever portion extending from said latch member and positioned to contact said portion of said trigger, said latch member and said trigger both pivotally mounted, spring means connected to both said latch member and said trigger to cause rotation of said latch member and said trigger in opposing directions whereby said throttle cushion dampens vibration between the throttle actuating rod and both trigger and said latch member of said means to operate the internal combustion engine.

* * * * *